US010912368B2

(12) United States Patent
Crapet et al.

(10) Patent No.: US 10,912,368 B2
(45) Date of Patent: Feb. 9, 2021

(54) RECEPTACLE, IN PARTICULAR A BOTTLE INTENDED FOR RECEIVING A COSMETIC PRODUCT

(71) Applicant: ALBEA SERVICES, Gennevilliers (FR)

(72) Inventors: Yann Crapet, Pontoise (FR); Thierry Balestrini, Leudeville (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 15/568,794

(22) PCT Filed: Apr. 19, 2016

(86) PCT No.: PCT/EP2016/058603
§ 371 (c)(1),
(2) Date: Oct. 23, 2017

(87) PCT Pub. No.: WO2016/169907
PCT Pub. Date: Oct. 27, 2016

(65) Prior Publication Data

US 2018/0098614 A1 Apr. 12, 2018

(30) Foreign Application Priority Data

Apr. 23, 2015 (FR) ..... 15 53655

(51) Int. Cl.
*A45D 34/04* (2006.01)
*A45D 40/26* (2006.01)
(Continued)

(52) U.S. Cl.
CPC ..... *A45D 34/046* (2013.01); *A45D 40/267* (2013.01); *B65D 41/04* (2013.01); *B65D 51/32* (2013.01)

(58) Field of Classification Search
CPC .... A45D 34/046; A45D 40/267; B65D 51/32; B65D 41/04
See application file for complete search history.

(56) References Cited

U.S. PATENT DOCUMENTS 3,817,637 A * 6/1974 Vasas ..... A45D 34/046 401/122
3,861,810 A * 1/1975 Vasas ..... A45D 33/00 401/122

(Continued)

FOREIGN PATENT DOCUMENTS

CN 101547839 9/2009
EP 0375476 6/1990

*Primary Examiner* — Frederick C Nicolas
*Assistant Examiner* — Randall A Gruby
(74) *Attorney, Agent, or Firm* — Steven M. Greenberg, Esq.; Shutts & Bowen LLP

(57) ABSTRACT

The invention relates to a receptacle (10), in particular a bottle intended for receiving a cosmetic product, comprising a wiper (20) that defines a wiping hole (21), said wiper (20) being fitted inside a portion of said receptacle (10), referred to as the body (11) of the receptacle (10), said receptacle (10) further comprising a rod (31) that can be removed from said body (11), said receptacle (10) further comprising an intermediate part (40) connected to said rod (31) so as to be able to slide between two positions, said intermediate part (40) being designed to be retained in and by the wiping hole (21), said intermediate part (40) being designed to wipe said rod (31) between said two positions.

8 Claims, 5 Drawing Sheets

Figure 1A:
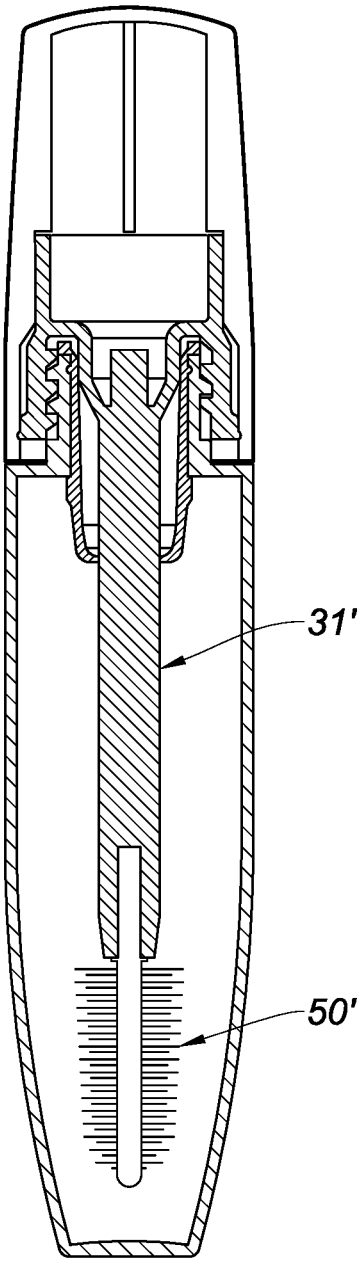

(51) Int. Cl.
*B65D 41/04* (2006.01)
*B65D 51/32* (2006.01)

(56) References Cited

U.S. PATENT DOCUMENTS 4,175,574 A * 11/1979 Zulberti ..... A45D 40/267 401/122
4,407,311 A * 10/1983 Gueret ..... A45D 34/047 401/122
4,705,053 A * 11/1987 Goncalves ..... A45D 40/268 132/218
5,349,972 A * 9/1994 Dirksing ..... A45D 40/267 132/218
5,599,125 A * 2/1997 Vasas ..... A45D 40/267 401/122
5,876,138 A * 3/1999 Gueret ..... A45D 40/267 132/218
5,899,622 A * 5/1999 Gueret ..... A45D 34/045 401/122
6,010,265 A * 1/2000 Bouix ..... A45D 40/267 401/121
6,029,676 A * 2/2000 Dumler ..... A45D 34/046 132/218
6,261,017 B1 * 7/2001 Gueret ..... A45D 34/046 401/121
6,502,584 B1 * 1/2003 Fordham ..... A45D 34/046 132/218
6,505,631 B2 * 1/2003 Fischer ..... A45D 40/0087 132/218
6,565,276 B1 * 5/2003 Diaz ..... A45D 40/267 132/119.1
7,044,669 B2 * 5/2006 Winckels ..... A45D 34/046 401/122
7,104,716 B2 * 9/2006 Petit ..... A45D 40/24 401/122
7,186,044 B2 * 3/2007 Bailly ..... A45D 40/267 132/218
7,278,798 B1 10/2007 Kearney
7,309,183 B2 * 12/2007 Dumler ..... A45D 40/267 401/121
7,398,898 B2 * 7/2008 Bouix ..... A45D 34/045 222/183
7,452,151 B2 * 11/2008 Rousselet ..... A45D 40/267 401/122
8,292,531 B2 * 10/2012 Rauschert ..... A45D 40/268 401/129
8,459,891 B2 * 6/2013 Lhoyer ..... A45D 40/268 401/122
8,783,268 B2 * 7/2014 Gueret ..... A45D 40/265 132/218
8,944,714 B2 * 2/2015 Gueret ..... A46B 9/028 401/129
8,967,896 B2 * 3/2015 Johnson ..... A45D 40/267 401/130
9,801,449 B2 * 10/2017 Lequeux ..... A45D 34/045
10,413,040 B2 * 9/2019 Jeong ..... B65D 51/32
10,420,410 B2 * 9/2019 Chevalier ..... A45D 40/262
10,494,159 B2 * 12/2019 Kneer ..... B65D 51/20
2010/0266327 A1 * 10/2010 Lin ..... A45D 40/267 401/122
2012/0039659 A1 * 2/2012 Sanchez ..... A45D 40/265 401/122
2014/0016983 A1 * 1/2014 Kim ..... A45D 40/268 401/122
2018/0027944 A1 2/2018 Kim et al.
2018/0140082 A1 * 5/2018 Prade ..... A46B 9/021
2018/0186514 A1 * 7/2018 Jeong ..... A45D 40/264
2019/0239618 A1 * 8/2019 Wolfe ..... A45D 34/046
2019/0239619 A1 * 8/2019 Kwon ..... A45D 34/045
2019/0298049 A1 * 10/2019 Castex ..... B29C 64/153
2019/0307229 A1 * 10/2019 Lee ..... A45D 34/04
2019/0350341 A1 * 11/2019 Cho ..... A45D 40/18
2020/0022481 A1 * 1/2020 Cho ..... A45D 40/267
2020/0069031 A1 * 3/2020 Cabon ..... A45D 40/267

* cited by examiner

RECEPTACLE, IN PARTICULAR A BOTTLE INTENDED FOR RECEIVING A COSMETIC PRODUCT

CROSS-REFERENCE TO RELATED APPLICATIONS

This application is a § 371 national phase entry of International Application No. PCT/EP2016/058603, filed Apr. 19, 2016, which claims priority to French Patent Application No. 1553655, filed Apr. 23, 2015.

The invention relates to a receptacle, in particular a bottle intended for receiving a cosmetic product.

Receptacles from the prior art, in particular bottles intended for receiving a cosmetic product for applying make-up to a user's eyes, lips and/or nails, often comprise an applicator arranged on the end of a rod, which is itself rigidly connected to a cap capable of closing the receptacle. The rod is therefore wiped by a wiper fitted in the bottle.

It is known to provide a diameter, more specifically the internal diameter, of the wiping hole of the wiper that is substantially equal to that of the rod such that said rod is correctly cleaned. One of the drawbacks of said wiper is the requirement to provide rods having a relatively large external diameter.

One of the aims of the invention is to propose a wiper of this kind that would be independent of the design of said rods.

The invention therefore relates to a receptacle, in particular a bottle intended for receiving a cosmetic product, comprising a wiper that defines a wiping hole, said wiper being fitted inside a portion of said receptacle, referred to as the receptacle body, said receptacle further comprising a rod that can be removed from said body.

According to the invention, said receptacle further comprises an intermediate part that is connected to said rod so as to be able to slide between two positions, said intermediate part being designed to be retained in and by the wiping hole and being designed to wipe said rod between said two positions.

The use of an intermediate part in the receptacle of the invention has the advantage of making it possible to use a rod having a small diameter with respect to the diameter of the wiping hole. In particular, the intermediate part makes it possible in this case to wipe the rod in a manner that does not depend on the diameter of the wiping hole but rather on that of the intermediate part. In other words, the diameter of the rod is not designed according to the diameter of the inner hole of the wiper. Therefore, the solution of the invention makes it possible to wipe the rod without being dependent on the design thereof.

According to different embodiments of the invention, which can be taken together or separately:

- said intermediate part has an external shape that is intended to engage with the wiping hole so as to be retained, in said wiping hole, in particular by friction,
- said intermediate part has an external shape that is intended to engage with the wiping hole so as to be retained, in said wiping hole, in particular by means of a bead of material,
- said intermediate part has an external shape that is intended to engage with the wiping hole so as to block said wiping hole in a sealing manner,
- said intermediate part is in annular contact in said wiping hole,
- said rod extends in a main longitudinal extension direction, referred to as the main direction, between a proximal end and an opposite end, referred to as the distal end, said receptacle further comprising a first stop for the intermediate part,
- the receptacle of the invention further comprises a cap capable of being removably attached to said body,
- said rod extends from said cap,
- said first stop is a part that is stationary relative to said cap,
- said first stop is designed to introduce said intermediate part into the wiping hole, in other words said first stop is designed to push said intermediate part into the wiping hole,
- the receptacle of the invention further comprises a second stop positioned at the distal end,
- said second stop belongs to said rod,
- said second stop is integrally formed with said rod,
- said second stop is formed on an applicator of said receptacle,
- said applicator is intended for applying make-up to a user's eyelashes, eyebrows, lips and/or nails,
- said intermediate part is a rotationally symmetrical profiled part, centered on the rod,
- said intermediate part has an inner portion intended to engage with the rod, said inner portion having a shape close to that of the rod,
- said intermediate part is flared towards the distal end of the rod,
- said intermediate part is a washer.

Figure 1B:
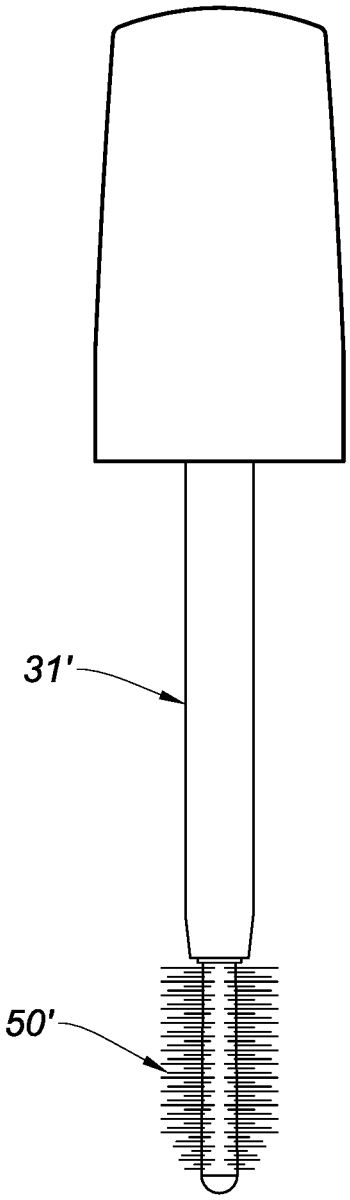
Figure 5:
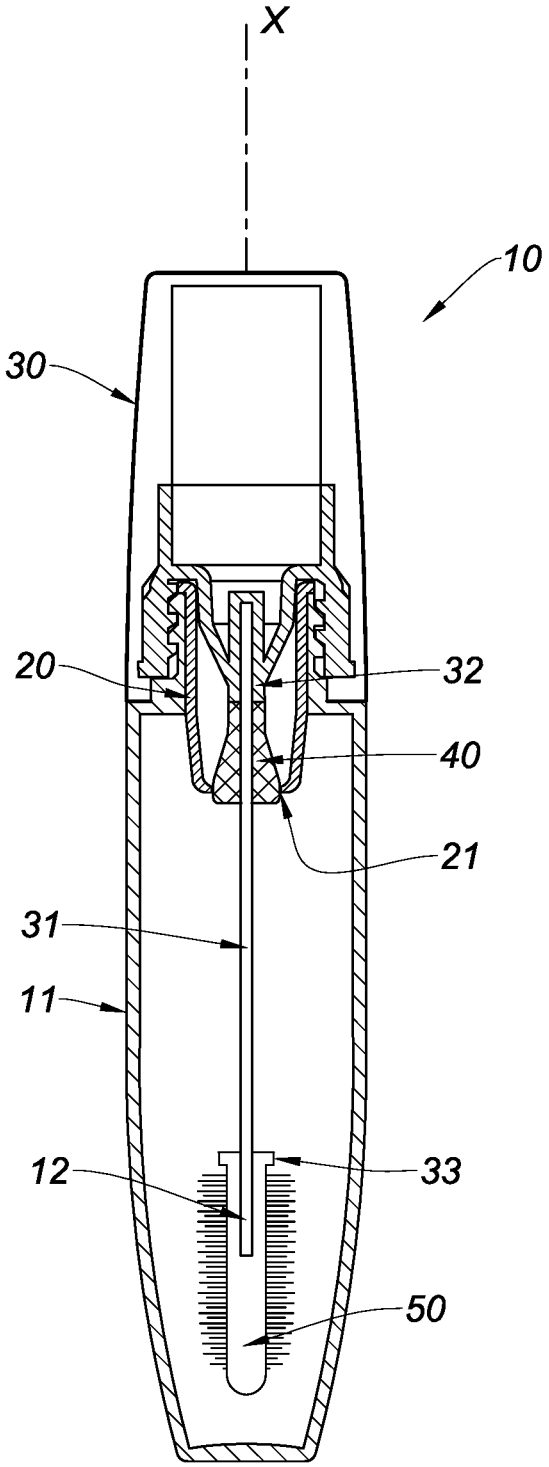
Figure 6:
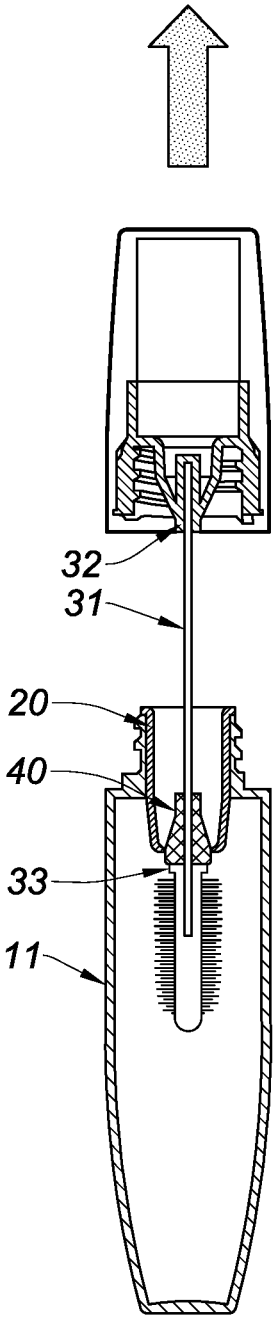
Figure 7:
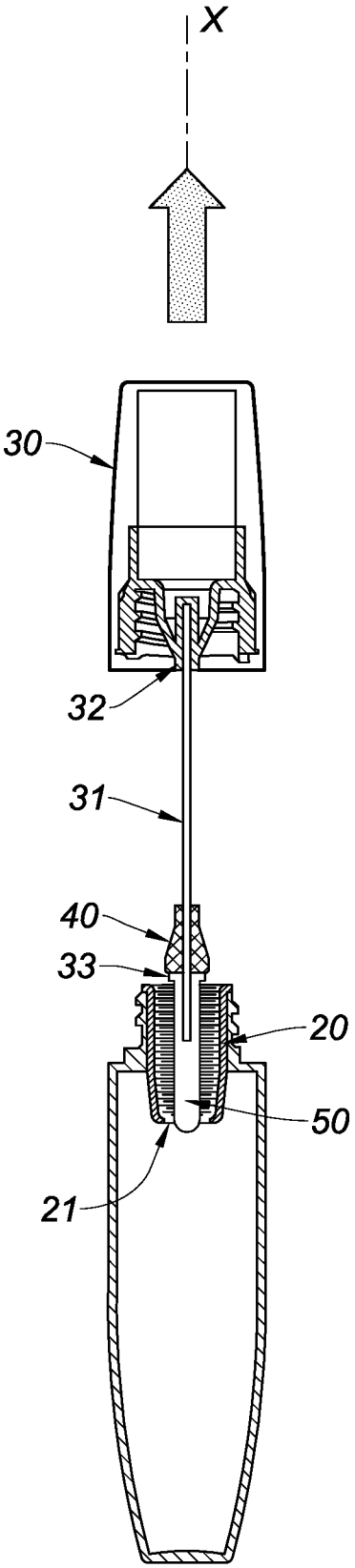

The invention will be better understood, and its other aims, details, features and advantages will become more clearly apparent on reading the detailed explanatory description that follows, of at least one embodiment of the invention given as a purely illustrative and non-limiting example, with reference to the accompanying schematic drawings, in which:

FIG. 1A is a sectional view of a receptacle from the prior art,

FIG. 1B is a partial view of FIG. 1A, namely a detailed view of a cap and a rod from the prior art, FIG. 2 to 5 are successive sectional views of the assembly of a cap together with a body of an embodiment of the receptacle according to the invention, FIG. 6 to 7 are successive sectional views of the disassembly of the cap from a body of the same embodiment of the receptacle as in FIG. 2 to 5, FIG. 8 is a sectional view of an embodiment of an intermediate part according to the invention, As shown in FIG. 2 to 7, the invention relates to a receptacle 10, in particular a bottle intended for receiving a cosmetic product.

Cosmetic product is understood to mean any product suitable for applying make-up to a user's eyes, eyelashes and/or eyebrows, lips and/or nails, or any dermatological product, moisturizing product and/or any product that treats areas of a user's skin for aesthetic reasons.

The receptacle 10 of the invention comprises a wiper 20 that defines a wiping hole 21 (see FIG. 5). Said wiping hole 21 has a diameter, in particular an internal diameter. Wiping hole (21) is understood to mean the circular cross section of the wiper having the smallest internal diameter. Said cross section is located at the lower end of the wiper. Alternatively, said cross section is located between the upper end and the lower end of the wiper. Said wiper 20 is advantageously fitted inside a portion of said receptacle 10, referred to as the body of the receptacle and denoted by reference sign 11 in the drawings. Said body 11 is intended to receive the cosmetic product in an inner space that said body defines.

The receptacle 10 may further comprise a cap 30 capable of being removably attached to the body 11 of said receptacle 10, and a rod 31 extending from said cap 30. The cap 30 is preferable threaded, and the body 11 of the receptacle 10 advantageously comprises a threaded collar designed to engage therewith. The caps 30 and collars illustrated in FIG. 2 to 7 are not limiting; any other removable assembly system may be envisaged without departing from the scope of the invention, for example an assembly system that can be removed by engagement between a cam and a cam track may be used here.

It should be noted that the rod 31 may be fitted inside the cap 30 by a force fit, by overmoulding and/or by any other known mechanical means, without departing from the scope of the invention.

According to the invention, said receptacle 10 further comprises an intermediate part 40 connected to said rod 31 so as to be able to slide between two positions. In other words, if the rod 31 is cylindrical, said intermediate part 40 has an inner shape of the cylindrical type, allowing said part to slide along said rod 31. Within the context of the invention, the fit between the rod 31 and the inner shape of said intermediate part 40 is preferably substantially an interference fit, without being obstructive.

In addition, "two positions" is understood to mean two different positions of the intermediate part, in particular stop positions, along the rod 31, as will be explained in more detail in the following.

Furthermore, the wiper 20, and in particular the wiping hole 21 thereof, is designed to retain said intermediate part 40.

This means that the wiper 20 is made of a material that is elastic enough to deform when the intermediate part 40 passes therethrough. This also means that the wiper opening 21 is narrow enough to retain said intermediate part 40, or to prevent said intermediate part from passing through without stopping it. Said intermediate part (40) is therefore designed to be retained in and by the wiping hole (21).

FIG. 5 shows an embodiment of the intermediate part 40 trapped in the wiping hole 21 of said wiper 20. Slight deformation of the wiping hole 21 can be seen here, said intermediate part 40 being accommodated in the wiping hole 21. For example, the wiper 20 is made of a rubbery plastics material, in particular nitrile rubber (NBR).

Said intermediate part 40 is designed to wipe said rod 31 between said two positions. In other words, the inner portion of the intermediate part 40 is close enough to the rod 31 to scrape said intermediate part when the rod 31 slides relative thereto. In other words again, the inner portion of said intermediate part 40 is intended to engage with the rod 31 and has a shape similar to that of the rod 31. The inner portion of said intermediate part 40 therefore has an oval cross section if the rod 31 has an oval cross section, or a square cross section if the rod 31 has a square cross section.

It should be noted that the intermediate part 40 advantageously has an external shape intended to engage with the wiping hole 21 so as to be retained, in said wiping hole 21, by friction. This means that the intermediate part 40 may be in the form of an annular ring having a peripheral surface that comes into contact with the wiping hole 21 in order to retain said intermediate part 40 by friction. The contact may be continuous or broken by embossments.

It should also be noted that the intermediate part 40 may also have an external shape intended to engage with the wiping hole 21 so as to block said wiping hole 21 in a sealing manner by means of an annular contact in said wiping hole 21.

"Sealing" is understood to mean hermetically closing off the inner portion of the body 11 of said receptacle 10 from the outside. For this purpose, the intermediate part 40 is in the form of an annular ring of which the periphery is regular, said periphery forming a continuous annular contact with the wiper 20, for example at the wiping hole 21.

It should also be noted that the intermediate part 40 may be a washer, said washer 40 being in the form of a rotationally symmetrical profiled part, centered on the rod 31. In other words, said washer 40 may be cylindrical, chamfered at its edges, or frustroconical or even ogival. Said washer is advantageously provided in a material of a higher stiffness than that of the wiper 20, in particular in order to ensure elastic deformation when it passes through. Said washer 40 is made of polypropylene (PP) or polyoxymethylene (POM), for example. In other words, the material of the washer is stiff enough for it to be able to bear on the wiper 20.

Figure 2:
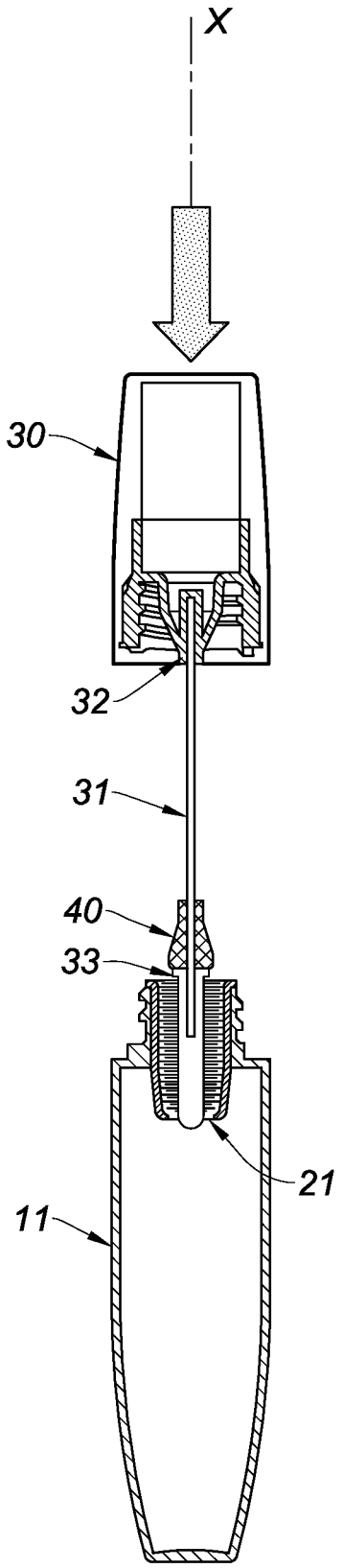
Figure 3:
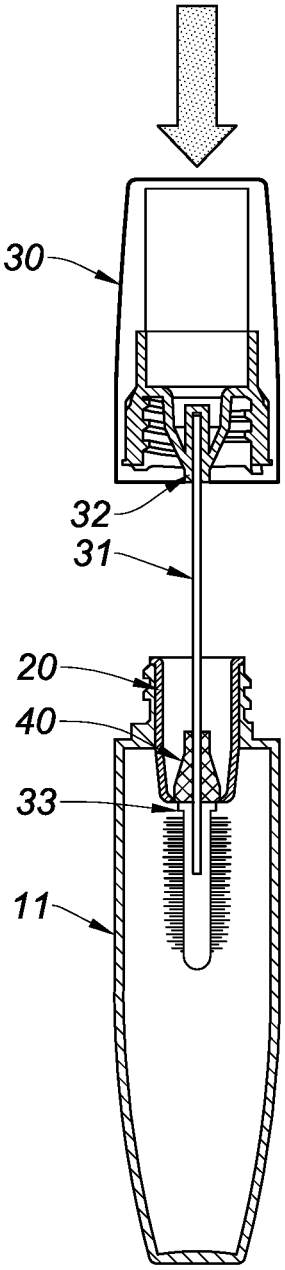
Figure 4:
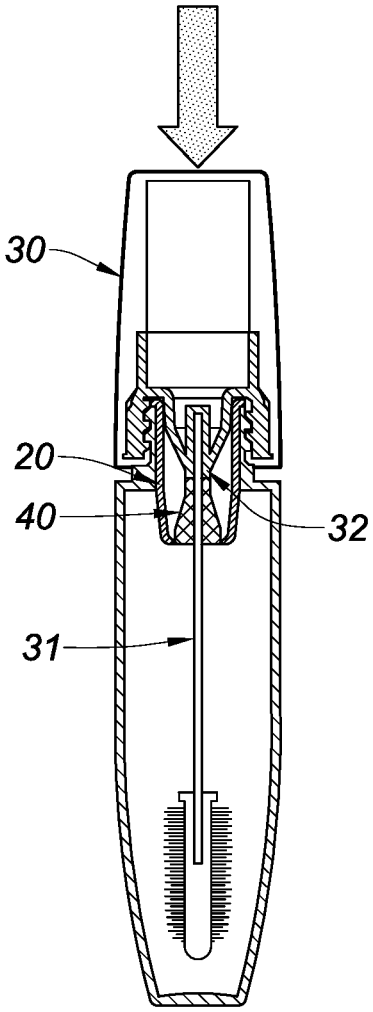

As can be seen in FIGS. 2, 5 and 7, said rod 31 extends in a main longitudinal extension direction, referred to as the main direction X. Said rod 31 extends in this case towards an end opposite the cap 30, referred to as the distal end, and is denoted by reference sign 12 in FIG. 5.

In addition, said receptacle 10 comprises a first stop 32 for the intermediate part 40. Said first stop 32 can be seen particularly clearly in FIG. 5. Said stop is located at said cap 30 and will be referred to as a stopper 32 in the following. Said stopper 32 is advantageously a part that is stationary relative to said cap 30. A stationary part is understood to mean a part that is fitted inside the cap, for example by a force fit, by gluing or by any other mechanical means that make it possible to fit two pieces one inside the other.

The receptacle of the invention further comprises a second stop 33 positioned at said distal end 12. Said second stop 33 belongs to the rod 31. Said second stop may be integrally formed with said rod 31, or overmoulded thereon.

It should be noted that the intermediate part 40 is designed so as to occupy, by engaging with said stops, the two positions mentioned above or any intermediate positions. More particularly, said intermediate part 40 is designed to occupy two configurations, specifically: a first configuration, referred to as the open configuration, or "use" configuration (shown in particular in FIGS. 2 and 7) and a second configuration, referred to as the closed configuration or "rest" configuration (shown in FIG. 5).

In the open configuration, the intermediate part 40 is free to move along said rod 31 between the stopper 32 and the second stop 33, while in the closed configuration it is retained in the wiping hole 21, as already mentioned.

As already shown in FIG. 2 to 5, the stopper 32 helps move from the open configuration to the closed configuration. To do this, the kinematic assembly formed by the cap 30, the stopper 32, the rod 31 and the second stop 33 is inserted into the body 11 of the receptacle 10, for example by a user, following the arrow pointing downwards along the axis X. The wiper, inserted in the body 11, allows the second stop 33 to pass but retains the intermediate part 40, in particular because the external diameter of said intermediate part is larger in this case than that of the wiping hole 21, in particular larger than the internal diameter of the wiping hole 21 (see FIG. 3).

The user continues to impart this movement until the receptacle 10 is closed, that is to say until the cap 30 is connected to said body 11. In this way, the stopper 32 thus pushes the intermediate part 40 into the wiping hole 21 by forcing the wiper 20 to deform (see FIGS. 4 and 5). In other words, the stopper 32 helps position the intermediate part 40 in the wiping hole 21, and the wiper 20, by means of its elastic design and the size of its hole 21, helps keep the intermediate part 40 in position in the wiper 20, in particular in its hole 21.

In other words again, said stopper 32 is designed to introduce said intermediate part 40 into the wiping hole 21, said intermediate part 40 thus forcing the elastic deformation of the wiper at its outermost, in particular annular, portion.

In other words again, said intermediate part 40 never passes completely through the wiper 20.

Therefore, in the closed configuration, there is no play between the intermediate part 40 and the stopper 32 (see FIG. 5).

Figure 8:
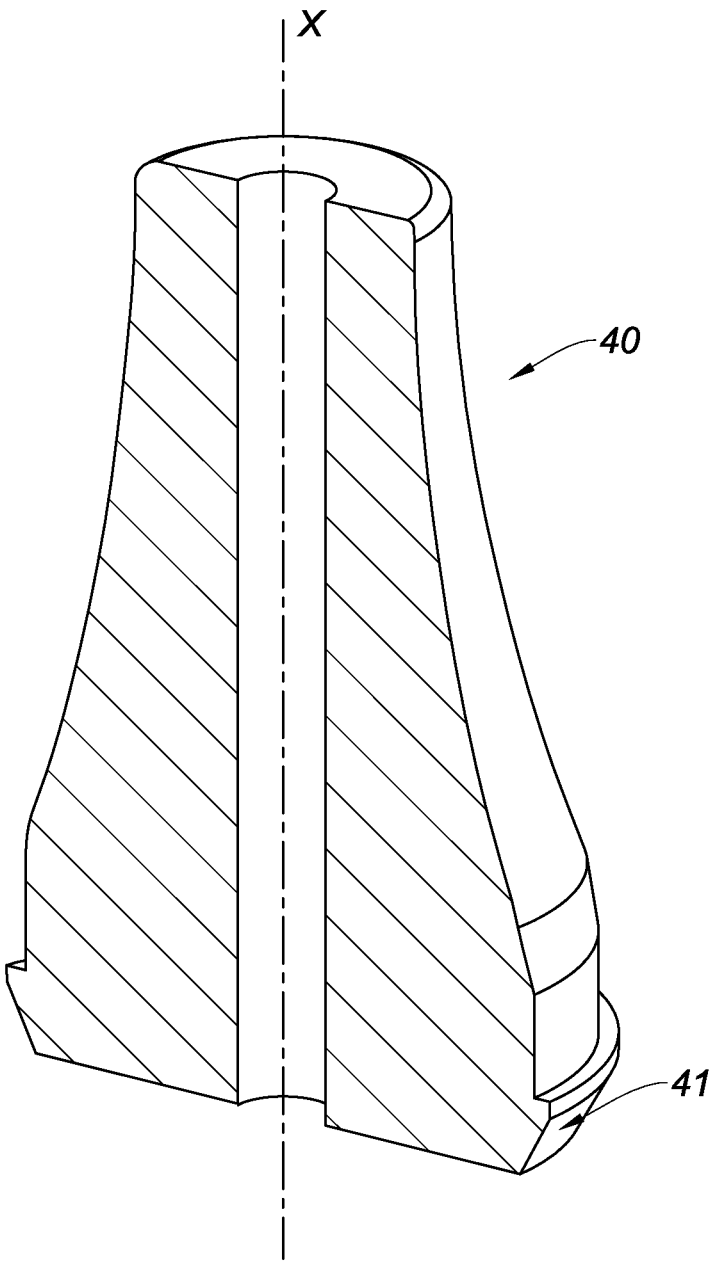

Furthermore, the intermediate part 40 may advantageously have an external shape that is intended to engage with the wiping hole 21 so as to be retained, in said wiping hole 21, in particular by means of a bead of material 41 (see FIG. 8). Said bead of material 41 may occupy, circumferentially, all of the external periphery of said intermediate part 40, or only be present in part around said periphery (this alternative is not shown here). Said bead of material 41, or knurled portion, whether continuous or discontinuous, makes it possible to ensure the intermediate part 40 is kept in position in the wiping hole 21, in particular in the closed configuration. Said bead of material 41 is advantageously provided at the end opposite the intermediate part 40 relative to the contact surface with the stopper 32.

It should be noted that the closed configuration advantageously ensures sealing at the receptacle 10 of the invention, as mentioned above.

The sealing is effective in the closed position (see FIG. 5). However, the sealing is not effective when there is simple contact with the wiper 20 (see FIGS. 3 and 4). Indeed, before being in the closed configuration, the receptacle 10 has the additional advantage of allowing a pistoning effect, commonly observed when receptacles of the prior art are closed, to be eliminated.

Indeed, as long as the intermediate part 40 is not retained in the wiping hole 21, said part can slide along the rod 31, thus making it possible for air to escape the inner portion of the body 11 of said receptacle 10, in particular to prevent said pistoning effect. This is particularly advantageous if the cosmetic product is very thick and/or viscous, in particular when the cosmetic produce is intended for applying make-up to the lips, more particularly when the cosmetic product is gloss.

Furthermore, as already shown in FIG. 6 to 7, the second stop 33 helps move from the closed configuration to the open configuration. To do this, the kinematic assembly formed by the cap 30, the stopper 32, the rod 31 and the second stop 33 is removed, in particular progressively, from the body 11 following the arrow pointing upwards along the axis X. This removal takes place, in particular, after the cap 30 and the body 11 have been disassembled. The wiper 20, inserted in the body 11, retains the intermediate part 40; the rod 31 thus slides inside the intermediate part 40 without dislodging the intermediate part 40 from the wiper 20.

The rod 31 is therefore wiped, in particular over the entire length thereof, by the intermediate part 40.

It should also be noted that once the intermediate part 40 is in position in the wiper 20, it forms, together with said wiper 20, a ball joint for the rod 31. For this purpose, the wiper 20 is advantageously a part that is capable of undergoing small-strain elastic deformations. The rod 31 can therefore be moved fully in the body 11 of the receptacle 10 while sliding inside the intermediate part 40.

The user, by continuing to pull on the cap 30, thus forces the intermediate part 40 free, in particular by means of the second stop 33 which, as it is rigidly connected to the rod 31, moves the intermediate part 40 therewith (see FIG. 7). In other words, the second stop 33 helps to disengage the intermediate part 40 from the wiping hole 21. In other words again, said second stop 33 is designed to remove the intermediate part 40.

Preferably, said receptacle 10 comprises an applicator 50 attached at the distal end 12 of said rod 31. The second stop 33 is formed on said applicator 50.

The stop 33 is advantageously formed by moulding on said applicator 50, or is overmoulded on said applicator.

Said applicator 50 is advantageously intended for applying make-up to a user's eyelashes, eyebrows, lips and/or nails, The applicator 50 is, for example, in the form of a fibre brush, a plastics brush, a hybrid brush, a fibrous brush, a moulded brush, moulded fingers, an assembly that is moulded then flocked and/or a hollow applicator that is intended to retain cosmetic product when it is removed from the body of the recipient 10.

The ball joint formed by positioning the intermediate part 40 in the wiper 20 makes it possible to optimally load the applicator 50 located at the end of said rod 31. Indeed, said ball joint makes it possible to pick up a higher percentage of cosmetic product initially contained in the body 11 of the recipient 10. In other words, moving the rod 31 inside said body 11, while bearing on said ball joint, makes it possible to scrape the product contained in the body 11 of the recipient 10, precisely on the walls of said body 11. This is particularly advantageous in the case of a cosmetic product, of the mascara type, which sometimes sticks inside the body 11 of the recipient 10 in hard-to-reach areas (for example, under the collar, on the walls, at the bottom of the body 11).

It should be noted again that variants are of course possible. In particular, in embodiments that are not shown here, the rod 31 can be in a different form having an attachment portion capable of receiving an applicator sleeve 50, said attachment portion being connected to the rod 31 or overmoulded thereon.

It should be noted that the applicator 50 preferably has two opposite distal ends: a first end (referred to as the proximal end) in the vicinity of said attachment portion, and a second free end (referred to as the distal end) opposite the first end, in particular along the axis X. Said stop 33 is advantageously formed in the vicinity of said proximal end of the applicator 50.

The applicator 50 may also be directly moulded or overmoulded on said rod 31.

Said rod 31 can be made of metal, plastics material, composite material and/or fibrous material. An example of plastics material for the rod is polyoxymethylene (POM) or polybutylene terephthalate (PBT). An example of fibrous material may be made of wood that has been treated to withstand cosmetic products of this kind.

By way of example, it is possible to provide a rod 31 made of stainless steel and having an external diameter of approximately 1.20 mm which carries a plastics brush 50 having an external diameter of approximately 9.2 mm (or a fibre brush having an external diameter of 10.5 mm) intended to be wiped by a wiper 20, the wiping hole 21 of which has an internal diameter of 6 mm.

"External diameter" is understood to mean an envelope diameter of the brush, said envelope being formed by the free ends of the protrusions, or of the fibres projecting from said brush. It should be noted that the above example is not limiting and that the external diameter of the brush may be between 7 and 11 mm, for example.

In this case, said rod 31 is made of metal and the applicator 50 is of the moulded plastics type and has protrusions that are integrally formed with a central core of the applicator 50 attached to said rod 31.

The receptacle of the invention therefore makes it possible to go beyond the rods 31' of the prior art (see FIG. 1) which have, over the entire length thereof, a constant diameter close to that of the wiping hole 21. For example, in this case, the diameter of the rod 31' shown in FIG. 1 is approximately 6.2 mm, in particular such that the rod 31' is cleaned when it passes a wiper that has a similar diameter, and also such that the applicator 50' carried by said rod 31' is wiped.

Therefore, the diameter of the rod 31 according to the invention, denoted d31, and the internal diameter of the wiping hole D21 advantageously follow the following formula:

$$0.15 \leq d31/D21 \leq 0.6.$$

The diameter of the rod 31, denoted d31, and the diameter of the applicator D50 are advantageously linked by the formula:

$$0.10 \leq d31/D50 \leq 0.5.$$

The receptacle 10 of the invention can be used in particular together with a rod 31 having a small diameter and a large applicator 50, in particular an applicator 50 that only needs to be wiped to a small extent.

Advantageously in this case, the applicator 50 is wiped by the wiper 20 and, owing to the intermediate part 40 and the diameter of the rod 31, which is smaller than the diameter of the wiping hole 21, the wiper 20 itself never wipes the rod 31. It is the intermediate part 40 that wipes the rod 31. In other words, the function of wiping the rod 31 is relocated, in particular to the intermediate part 40.

Furthermore, when the intermediate part 40 is clear of or released from the wiping hole 21, said hole returns to its original shape owing to the elastic return of the material of which it is made, then the wiping hole 21 advantageously helps to wipe the applicator 50, in particular protrusions and/or fibres projecting from said applicator 50. The stop 33 advantageously has a height, measured along the axis X, that allows the wiping hole 21 to return to its original shape before coming into contact with said applicator 50.

In addition, the user of a receptacle 10 according to the invention may apply make-up without their vision being impaired by a rod 31' of which the diameter is too large.

The alternatives set out above may be combined without departing from the scope of the invention.

The invention claimed is:

1. A receptacle comprising:

a wiper that defines a wiping hole, said wiper being fitted inside a body portion of said receptacle, said wiping hole comprising a circular cross section of the wiper having a smallest internal diameter;

a rod that can he removed from said body;

an intermediate part comprising an end with a circumferential head, the intermediate part connected to said rod so as to he able to slide between two positions along the rod, said intermediate part being designed to he retained in the wiping hole by contact of the intermediate part with an annular inner surface of the wiping hole at the location of the circular cross section of the wiper having a smallest internal diameter and to wipe said rod between said two positions;

wherein said wiper is made of elastic material so as to deform when the intermediate part passes therethrough;

Wherein said rod extends in a main longitudinal extension direction between a proximal end and an opposite distal end, said receptacle further comprising a first stop for the intermediate part positioned at said proximal end of the rod and a second stop positioned at said distal end of the rod;

said second stop configured to remove said intermediate part from the wiping hole upon removal of the rod from the body.

2. A receptacle according to claim 1, wherein the intermediate part has an external shape intended to engage with the wiping hole so as to be retained, in said wiping hole, by friction.

3. A receptacle according to claim 1, wherein said intermediate part has an external shape intended to engage with the wiping hole so as to block said wiping hole in a sealing manner.

4. A receptacle according to claim 1, further comprising a cap capable of being removably attached to the body, said rod extending from said cap.

5. A receptacle according to claim 4, wherein said first stop is a part that is stationary relative to said cap, said first stop being designed to introduce said intermediate part into the wiping hole.

6. A receptacle according to claim 1, wherein said second stop is formed on an applicator of said receptacle.

7. A receptacle according to claim 6, wherein said applicator is intended for applying make-up to a user's eyelashes, eyebrows, lips and/or nails.

8. A receptacle according to claim 1, wherein said intermediate part is a rotationally symmetrical profiled part, centered on the rod.

* * * * *